US005487114A

United States Patent [19]

Dinh

[11] Patent Number: 5,487,114

[45] Date of Patent: Jan. 23, 1996

[54] MAGNETLESS SPEAKER

[76] Inventor: Khanh Dinh, 1618 SW. 76th Ter., Gainsville, Fla. 32607

[21] Appl. No.: 191,325

[22] Filed: Feb. 2, 1994

[51] Int. Cl.[6] ..... H04R 25/00

[52] U.S. Cl. ..... 381/192; 381/194

[58] Field of Search ..... 381/194, 192, 381/199, 195, 117, 203, 207, 196, 96

[56] References Cited

U.S. PATENT DOCUMENTS

| | | | |
|---|---|---|---|
| 314,156 | 3/1885 | Taylor | 381/194 |
| 1,640,436 | 8/1927 | Barton | 381/117 |
| 1,643,791 | 9/1927 | Slepian | 381/203 |
| 1,733,232 | 10/1929 | Miessner | 381/117 |
| 1,808,149 | 6/1931 | Smith | 381/199 |
| 1,830,402 | 11/1931 | Miessner | 381/195 |
| 1,849,495 | 3/1932 | Lyle | 381/117 |
| 1,920,299 | 8/1933 | Fanger | 381/199 |
| 1,976,874 | 10/1934 | Brzeski | 381/194 |
| 1,992,300 | 2/1935 | Fanger | 381/195 |
| 2,030,574 | 2/1936 | Dull | 381/194 |
| 2,727,949 | 12/1955 | Lokkesmoe | 381/117 |
| 4,276,452 | 6/1981 | Suyama et al. | 381/203 |

FOREIGN PATENT DOCUMENTS

| | | | |
|---|---|---|---|
| 55-38766 | 3/1980 | Japan | 381/196 |
| 0232798 | 10/1986 | Japan | 381/192 |

*Primary Examiner*—Curtis Kuntz
*Assistant Examiner*—Huyen D. Le
*Attorney, Agent, or Firm*—Nilles & Nilles

[57] ABSTRACT

A lightweight speaker is constructed without permanent magnets by providing two coils, one of which is mounted on a movable membrane and the other of which is mounted on a fixed frame. The coils are mounted in close proximity to one another and excited by a common source signal from a common amplifier or the like in such a fashion that the electromagnetic fields created by the coils upon excitation interact to cause the coils to alternately attract and repel one another. One of the coils is fed with an excitation signal directly from the source. The other coil receives the source signal only indirectly, preferably via a bridge rectifier. The coils may take the form of conventional wound wires or, in a particularly sophisticated yet inexpensive embodiment, may be formed on a printed circuit board in the form of flat spirals. The resulting speaker is very lightweight and thus is well suited for use in automobiles, airplanes, and other applications in which weight minimization is important.

5 Claims, 4 Drawing Sheets

MAGNETLESS SPEAKER

BACKGROUND OF THE INVENTION

1. Field of the Invention

The invention relates to speakers, and more particularly, relates to speakers constructed without permanent magnets to minimize weight.

2. Discussion of Related Art

Referring to FIG. 1, a typical speaker 10 contains a stationary support frame 12, a permanent magnet 14 mounted on the support frame 12, a movable membrane 16 covering the support frame 12, and a voice coil 18 mounted on the movable membrane 16. As is known by those skilled in the art, vibrations are induced in the voice coil 18 and membrane 16 when an alternating source signal is supplied to the voice coil 18 by an amplifier or the like and the induced magnetic field interacts with the magnetic field of the permanent magnet 14 to alternately attract and repel the voice coil 18. Such speakers work well but are relatively large and heavy since a permanent magnet may weigh as much as several pounds or more. Conventional permanent magnet speakers thus loose their attractiveness in many applications such as automobiles, airplanes, or any other application in which weight is a concern. Conventional permanent magnet speakers also begin to loose their attractiveness in applications such as high powered woofers in which the sheer size and weight of the permanent magnet required for the speaker increases the weight of the speaker beyond acceptable limits.

Magnetless speakers are known and were in fact in wide use prior to the advent of reliable permanent magnets. That is, in the early days of speaker technology when permanent magnets were not stable and had the tendency to loose their magnetism, speakers were manufactured with a continuously powered stationary electromagnet. Referring to FIG. 2, such speakers 20 include a frame 22, an electromagnet 24 mounted on the frame 22, a movable membrane 26 mounted on the frame 22, and a voice coil 27 mounted on the membrane 26 and movable therewith. The coil 28 of electromagnet 24 or field coil is continuously powered by an internal DC power source 29 such as a battery to produce a constant-polarity magnetic field for interaction with the alternating field in voice coil 27. Speakers employing permanent electromagnets were not only heavy and cumbersome because they required their own internal power source, but were also very inefficient and were replaced by permanent magnet speakers as soon as permanent magnet technology was suitably developed. The electromagnets of such speakers, being powered by an independent power sources, also were necessarily not excited in proportion to the source signals exciting the voice coils.

OBJECTS AND SUMMARY OF THE INVENTION

It is therefore an object of the invention to provide an efficient, lightweight speaker usable in automobiles, airplanes, and other applications in which weight minimization is important.

Another object of the invention is to provide a speaker having the attributes discussed above but which at the same time does not require a power source apart from the signal current generator.

In accordance with a first aspect of the invention, this and other objects are achieved by providing a magnetless speaker comprising a first coil receiving an excitation signal directly from a source such as an amplifier, and a second coil receiving the excitation signal from the source only indirectly. A particularly preferred device for supplying the excitation signal to the second coil is a bridge rectifier. The first and second coils will typically be mounted on a fixed frame and a movable membrane, respectively.

The power of the speaker can be increased by installing a second set of coils in parallel with the set of coils. The second set of coils, like the first set, includes a stationary coil mounted on the frame and a movable coil mounted on the membrane. One of the stationary and movable coils of the second set receives the source signal directly, and the other coil receives the source signal from a bridge rectifier or any other suitable device.

Sound wave travel can be increased by installing at least one additional movable coil in series with the stationary and movable coils and powering the additional coil such that vibrations imposed in each coil add motion to an adjacent coil.

The efficiency of the speaker can be enhanced by providing means for directing and containing magnetic fields produced by the stationary and movable coils. The means for directing and containing may comprise ferro-magnetic laminations, ferro-magnetic cores around which the coils are wound, or any other suitable device.

Yet another object of the invention is to provide a method of generating sound using a speaker having one or more of the attributes discussed above.

In accordance with another aspect of the invention, this object is achieved by providing a method including providing a speaker including a stationary coil fixed to a frame and a movable coil mounted on a movable membrane, generating a source signal, transmitting the source signal directly to one of the stationary and movable coils, and transmitting the source signal to the other of the stationary and movable coils only indirectly.

Preferably, the step of transmitting the source signal to the other coil comprises rectifying the source signal prior to transmission to the other coil.

Other objects, features, and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications could be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

1. Resume

Pursuant to the invention, a lightweight speaker is constructed without permanent magnets by providing two coils, one of which is mounted on a movable membrane and the other of which is mounted on a fixed frame. The coils are mounted in close proximity to one another and excited by a common source signal from a common amplifier or the like in such a fashion that the electromagnetic fields induced in the coils upon excitation interact to cause the coils to alternately attract and repel one another. One of the coils is fed with an excitation signal directly from the source. The other coil receives the source signal only indirectly, preferably via a bridge rectifier. The coils may take the form of conventional wound wires or, in a particularly sophisticated, yet inexpensive embodiment, may be formed on a printed circuit board in the form of flat spirals. The resulting speaker is very lightweight and thus is well suited for use in automobiles, airplanes, and other applications in which weight minimization is important.

2. Principle of Operation

Figure 1:
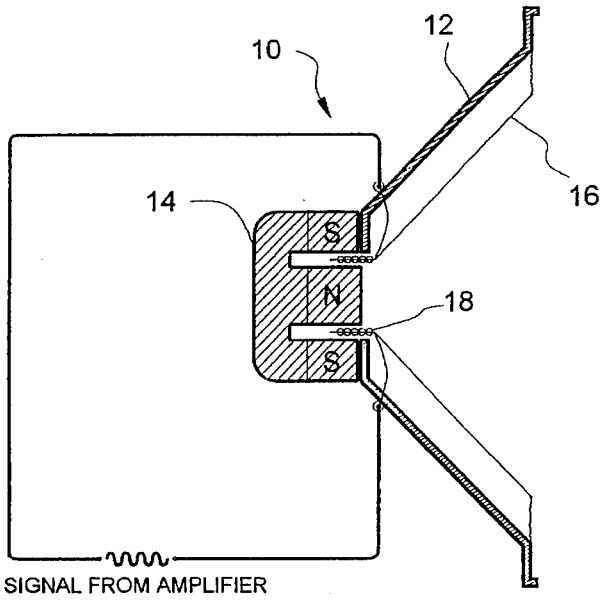
FIG. 1 (PRIOR ART)
FIG. 1 schematically illustrates a prior art permanent magnet bearing speaker, appropriately labeled "PRIOR ART"
Figure 2:
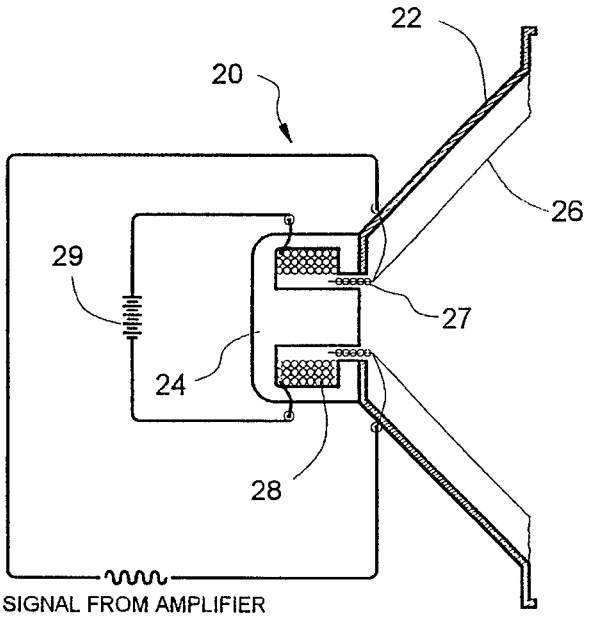
FIG. 2 (PRIOR ART)
FIG. 2 schematically illustrates a prior art magnetless speaker, appropriately labeled "PRIOR ART"
Figure 3:
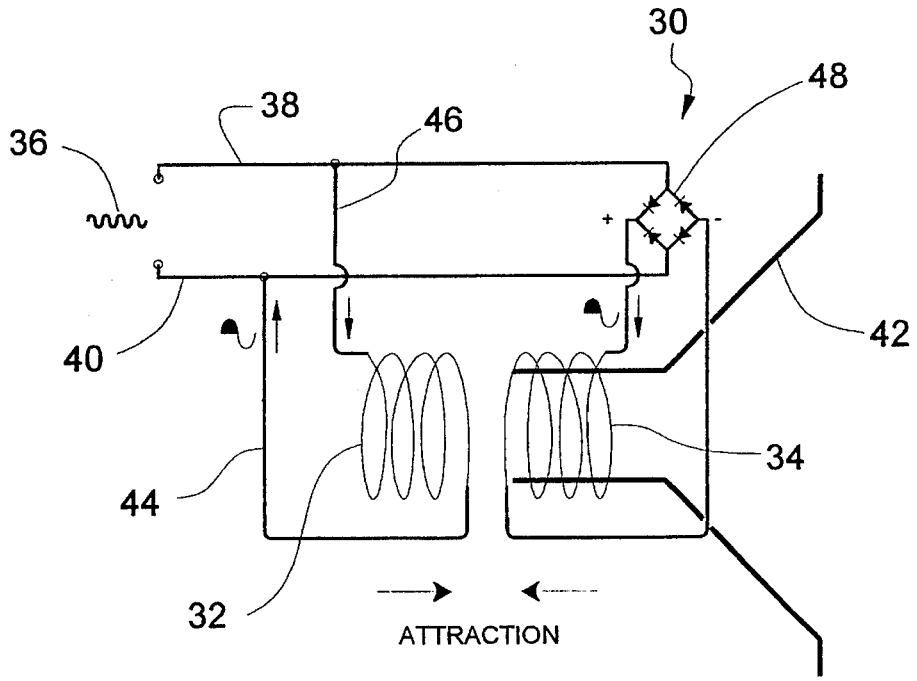
FIGS. 3 and 4 schematically illustrate the principle of operation of a magnetless speaker constructed in accordance with the present invention.
Figure 4:
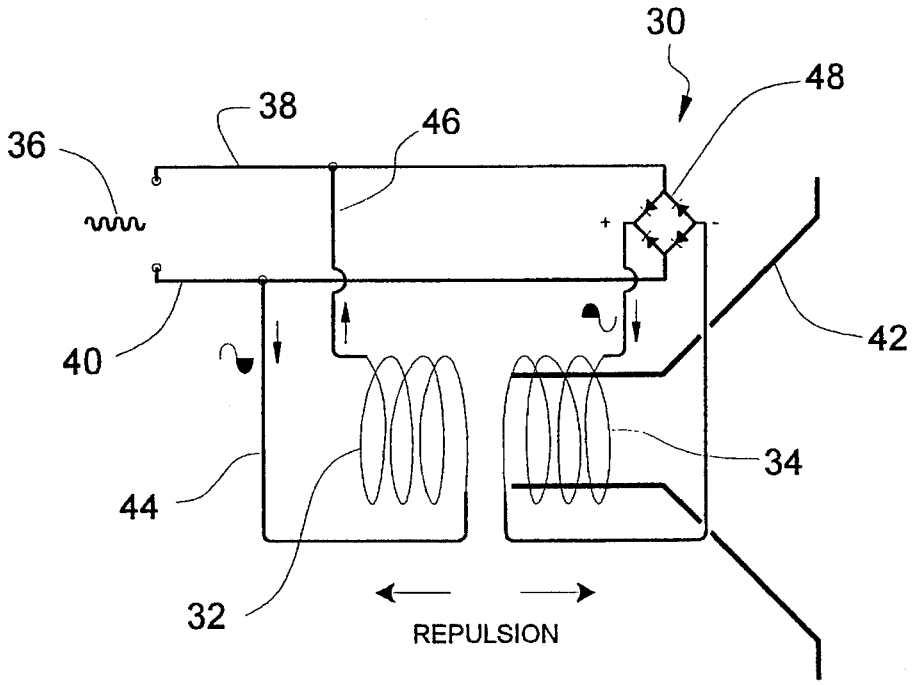

Referring now to FIGS. 3 and 4, a speaker 30 constructed in accordance with and operating under the principals of the invention includes first and second coils 32 and 34 powered from a source of alternating current such as an amplifier 36 or any other suitable device. The source signal current is fed to the coils 32 and 34 from the amplifier 36 by first and second conductors 38 and 40 which may take the form of wires, printed circuits, or any other power conducting devices.

The coils 32, 34 are located in close proximity to one another with one coil being mounted on a suitable fixed frame (not shown) and the other coil being mounted on a movable membrane 42 covering the frame. The first coil 32 receives the source current from amplifier 36 directly from the conductors 38, 40 and further leads or conductors 44, 46. The second coil 34, on the other hand, while being excited by the same source current from the amplifier 36, receives this current only indirectly and in a modified fashion so as to be energized at least partially out of phase with energization of the first coil 32. For instance, excitation of the second coil 34 could be induced by current in the first coil 32 or in the conductors 38 and 40 supplying the source current to the first coil. However, in the illustrated and preferred embodiment, the source current is fed to the second coil 34 via a bridge rectifier 48 connected to the conductors 38 and 40 via first and second leads and to the second coil 34 via third and fourth leads and converting the AC signal supplied by the amplifier 36 to a proportional DC signal. The polarities of the fields induced in coils 32 and 34 will thus be either the same or the opposite, depending upon the phase of the current in conductors 44, 46. As a result, the coils 32, 34 will be alternately attracted toward one another as illustrated in FIG. 3 and repulsed from one another as illustrated in FIG. 4, thus resulting in vibrations of the membrane 42 and sound generation.

As can be appreciated from the above discussion, both coils 32 and 34 will be excited in proportion to the source signal current—a marked advantage over prior art magnetless speakers employing an independent power source. More importantly, the resulting speaker 30 lacks both a permanent magnet and an independently powered electromagnet. Speaker 30 is thus smaller, lighter, and in many respects simpler than prior art speakers.

In the illustrated embodiment, the first coil 32 is mounted on the frame, and the second coil 34 is mounted on the membrane 42. However, these coils could be reversed without affecting the operation of the speaker 30.

The operation of the speaker 30 can be optimized by employing as a signal current source a relatively powerful amplifier 36 delivering power on the order of 100 watts, and by employing a very efficient solid state bridge 48 rectifier as the rectifier. However, less powerful and/or efficient devices could be employed in applications in which high quality sound reproduction is less important.

Coils operating under the principles discussed above can be provided in several different forms and combined in several different ways for different applications. Some such applications will now be described.

3. Applications of Magnetless Speakers

Figure 5:
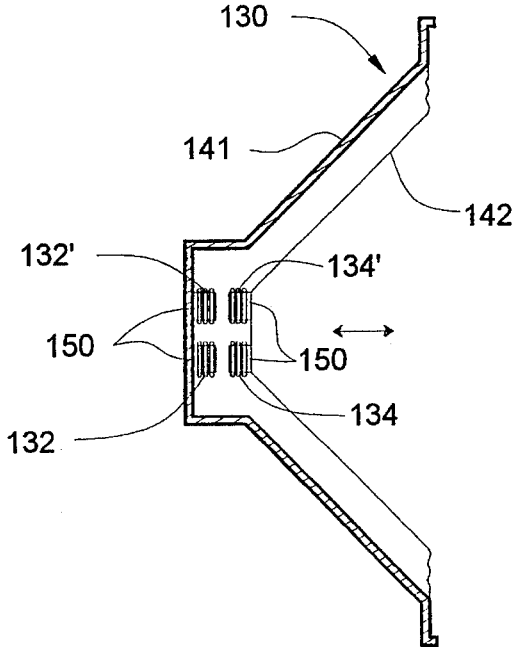
FIG. 5 schematically illustrates a magnetless speaker constructed in accordance with the present invention and having parallel coils for more power.

Referring to FIG. 5, a speaker 130 may be constructed operating under the principles detailed in Section 2. above and having two or more sets of coils provided in parallel with one another for increased power. Each set includes first and second coils 132, 134; 132', 134' mounted in close proximity to one another on a speaker frame 141 and a membrane 142, respectively. One of the coils 132, 132' of each set is powered by the source signal directly from an amplifier and the other is powered by the same signal via a bridge rectifier as disclosed above. FIG. 5 also illustrates how the efficiency of the speaker 130 can be increased by winding the coils 132, 132', 134, 134' around ferro-magnetic cores 150 tending to direct and contain the magnetic fields produced by the coils 132, 134, 132', 134'. Other ferro-magnetic members such as ferro-magnetic laminations could also be used for this purpose.

Figure 6:
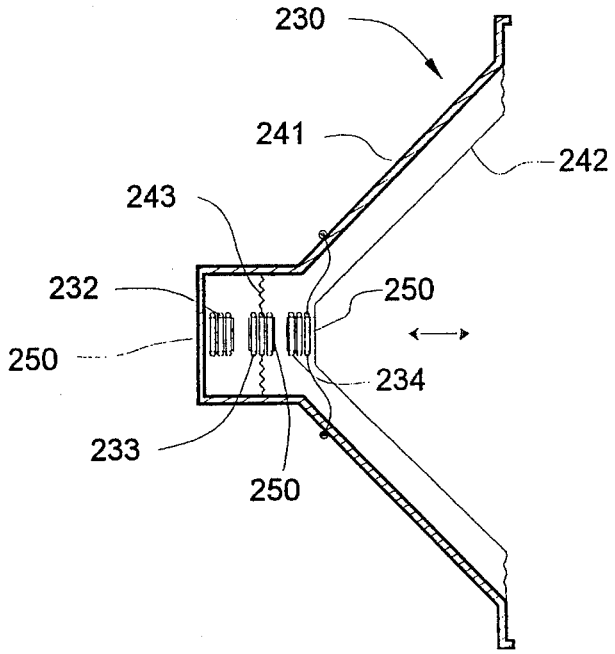
FIG. 6 schematically illustrates a magnetless speaker constructed in accordance with the present invention and having serial coils for longer travel.

In applications such as woofers in which longer travel of the sound waves is desired, additional coils may be provided in series with the first and second coils such that the motions induced in each coil adds to the motion of the next coil in the series. Thus, as illustrated in FIG. 6, a speaker 230 could include a first coil 232 mounted on a speaker frame 241, a second coil 234 mounted on a speaker membrane 242, and a third coil 233 mounted on a movable membrane 243 disposed between the first and second coils 232 and 234. The first coil 232 is powered directly via a source signal from an amplifier, and the second coil 234 is powered by the source signal indirectly via a bridge rectifier as described in Section 2. above. The third coil 233 may be powered either directly by the source signal or indirectly by the source signal through a bridge rectifier or the like. In either case, the motion induced in each coil adds to the motion of the next coil in the series, resulting in longer sound wave travel. Or course, still further coils could be provided in series with coils 232, 233 and 234. As in the previous embodiment, ferro-magnet cores 250 or the like may be provided to direct and contain the magnetic fields induced in coils 232–234.

Figure 7:
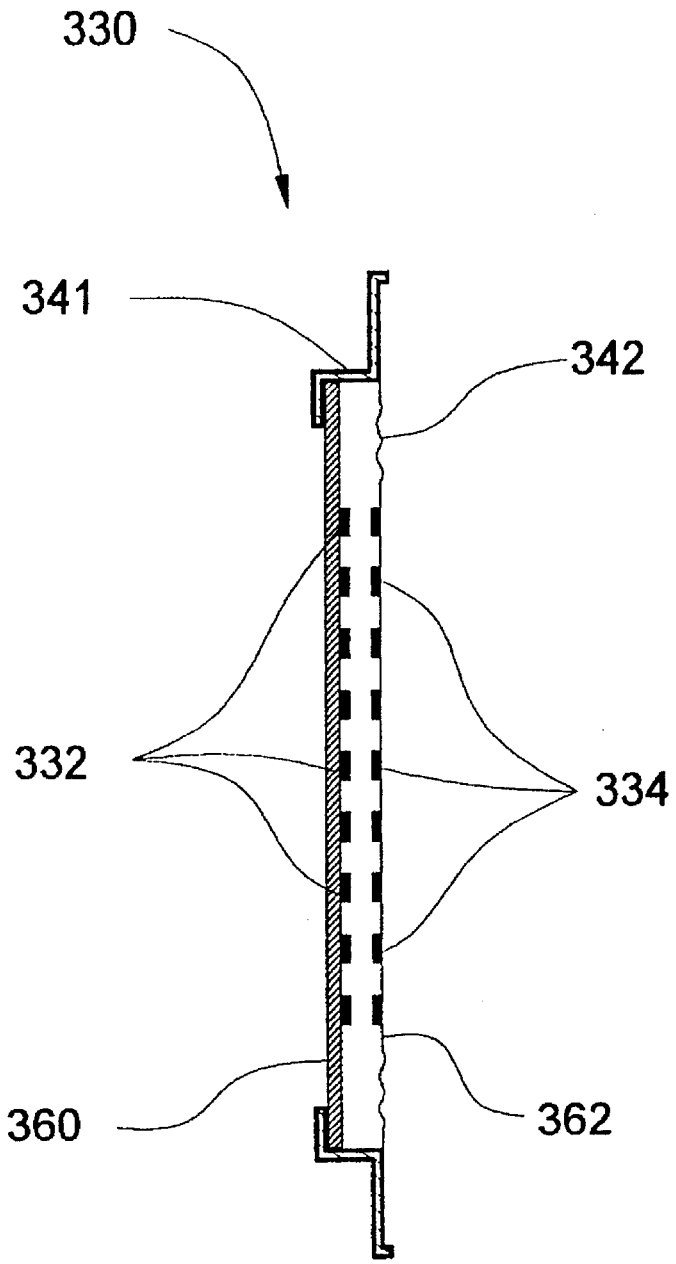
FIG. 7 schematically illustrates the magnetless speaker constructed in accordance with another embodiment of the present invention.

Coils other than traditional wound wire coils could be used for one or more of the coils of any set. For instance, coils could be made from foil or printed circuits. Referring to FIG. 7, a speaker 330 could also be formed from coils 332 and 334 provided on printed circuit boards 360, 362 in the shape of flat spirals and powered as described in Section 2 above. The circuit boards 360 and 362 are in turn mounted on the speaker frame 341 and the movable membrane 342, respectively. Such an arrangement may prove particularly attractive since, (1) it permits the use of many sets of parallel coils 332, 334 in a relatively small area, thus minimizing space as well as weight, (2) is very inexpensive to manufacture, and (3) the stationary printed circuit board 360 bearing the coils 332 can itself form part of the speaker frame 341, thus further reducing the weight of the speaker 330.

The arrangement illustrated in FIG. 7 works well in applications in which only relatively short sound wave travel is required, but is not as well suited for other applications because the vibration potential of flat spirals is rather limited. Flat spiral speakers such as that illustrated in FIG. 7 can, however, be easily adapted to applications in which longer sound wave travel is required by placing one or more additional movable circuit boards, each bearing a number of flat spiral coils, in series between the boards 332 and 334. As in the embodiment of FIG. 6, motions induced in the coils of each board would add to the motion of the coils of the next board in the series, resulting in longer sound wave travel.

Many changes and modifications could be made to the present invention without departing from the spirit thereof. For instance, one coil of each set could be inserted inside the other to further reduce space. Moreover, one coil of each set could be positively coupled to the signal current source, and the other coil could be excited inductively or via any other passive or active electronic circuits powered by the signal current source and permitting the required interaction between the coils. Other changes and modifications falling within the scope of the invention will become apparent from the appended claims.

I claim:

1. A magnetless speaker comprising:

A. a frame;

B. a movable membrane supported on said frame;

C. first and second conductors connected to an amplifier;

D. a stationary coil mounted on said frame and having first and second leads connected to said first and second conductors so as to be powered directly by said amplifier;

E. a bridge rectifier having (1) first and second leads connected to said first and second conductors in parallel with said first and second leads of said stationary coil and (2) third and fourth leads; and F. a movable coil mounted on said membrane in close proximity to said stationary coil and having first and second leads connected to said third and fourth leads of said bridge rectifier so as to be powered indirectly by said amplifier, wherein said stationary and movable coils produce interacting magnetic fields upon excitation by said amplifier, thereby causing said membrane to vibrate and to produce sound without the action of an auxiliary power source and without the action of a permanent magnet.

2. An apparatus as defined in claim 1, further comprising a second stationary coil mounted on said frame in parallel with said stationary coil and a second movable coil mounted on said membrane in parallel with said movable coil.

3. An apparatus as defined in claim 1, further comprising at least one additional movable coil arranged in series with said stationary and movable coils and powered such that vibrations imposed in each coil add motion to an adjacent coil.

4. An apparatus as defined in claim 1, wherein said coils comprise flat spirals provided on circuit boards.

5. An apparatus as defined in claim 1, further comprising means for directing and containing magnetic fields produced by said stationary and movable coils.

* * * * *